US005707303A

United States Patent [19]

Berkowitz et al.

[11] Patent Number: 5,707,303

[45] Date of Patent: Jan. 13, 1998

[54] GOLF BALL AND TEE SETTING AND RETRIEVING CANE DEVICE

[76] Inventors: Robert H. Berkowitz, 11 Fawn Dr., Livingston, N.J. 07039; Joseph Rubinstein, 20-3 America Way, Salem, Mass. 01970

[21] Appl. No.: 629,240

[22] Filed: Apr. 8, 1996

[51] Int. Cl.[6] ..... A63B 57/00

[52] U.S. Cl. ..... 473/386; 294/19.2

[58] Field of Search ..... 473/386, 282, 473/286; 294/19.1, 19.2

[56] References Cited

U.S. PATENT DOCUMENTS

| | | | |
|---|---|---|---|
| 2,346,038 | 4/1944 | Mason . | |
| 2,609,198 | 9/1952 | Armstrong . | |
| 2,834,629 | 5/1958 | Williams . | |
| 2,943,856 | 7/1960 | Eimerman . | |
| 3,093,402 | 6/1963 | Sisson . | |
| 3,467,116 | 9/1969 | Ringewaldt . | |
| 3,904,200 | 9/1975 | Jackle et al. . | |
| 4,013,295 | 3/1977 | Baughman . | |
| 4,299,246 | 11/1981 | Marsh . | |
| 4,398,759 | 8/1983 | Manola | 294/19.1 |
| 4,441,746 | 4/1984 | Corboy, Jr. | 294/19.1 |
| 4,526,369 | 7/1985 | Phelps . | |
| 4,589,661 | 5/1986 | Attig . | |
| 4,616,826 | 10/1986 | Trefts . | |
| 4,714,250 | 12/1987 | Henthorn . | |
| 4,811,750 | 3/1989 | McAllister . | |
| 4,819,938 | 4/1989 | Hill . | |
| 4,827,956 | 5/1989 | Toot . | |
| 4,949,961 | 8/1990 | Milano . | |
| 5,205,598 | 4/1993 | Miller . | |
| 5,310,177 | 5/1994 | Conrad et al. . | |
| 5,392,800 | 2/1995 | Sergi . | |
| 5,433,234 | 7/1995 | Lapere . | |
| 5,503,394 | 4/1996 | Mauck et al. | 473/386 |

*Primary Examiner*—Steven B. Wong
*Attorney, Agent, or Firm*—Klauber & Jackson

[57] ABSTRACT

A cane device for manipulating objects such as a golf ball and a tee as well as other objects, the tee having a head portion and a shank portion, and for assisting in supporting the weight of a user against a ground surface. The device comprises: a weight-bearing shaft, having a proximal end and a distal end; a handle disposed at the proximal end of the shaft; a gripping mechanism disposed at the distal end of the shaft for retrieving, grasping, and setting the objects, the gripping mechanism being capable of supporting the weight of the user; an actuation mechanism for activating and deactivating the gripping mechanism, disposed between the handle and the gripping mechanism. The gripping mechanism preferably comprises a pair of opposing jaw members, capable of contacting the ground surface and supporting the weight of the user.

2 Claims, 8 Drawing Sheets

20
44

22b
12
60
60
52b
52a
22a 22b
34
12
34
22a 22b
38
68
70
40
72
22a
38
68
70
40
18
72
10
20
44
42
46
54
66
26
48b
60
56
58
52b
22a
12
16
28
38
40
18
24
50b
48a
60
56
58
52a
32
34
40
14

10
20
57c
22a
22b
57b
59a
59b
59
57
59c
57a
21

GOLF BALL AND TEE SETTING AND RETRIEVING CANE DEVICE

FIELD OF THE INVENTION

The present invention relates to cane devices and golf ball and tee setting devices generally and, more particularly, but not by way of limitation, to a novel golf ball and tee setting and retrieving cane device.

BACKGROUND OF THE INVENTION

Many people afflicted with a disease, such as polio, rheumatoid arthritis, or other debilitating event or injury which limits the mobility and flexibility of the back, the hips, the knees, and other areas, are prevented from enjoying the game of golf due to their affliction. One of the most challenging tasks for such people is setting the tee into the ground, placing the ball on the tee, and thereafter retrieving the tee from the ground. Subsequently, the ball must also be retrieved. The rotational movement of the body during a golf swing is generally not as restricted as bending or crouching movements. Typically, these people, especially senior citizens, utilize a cane or walking stick for support while walking. Thus, such a user would necessarily bring a cane or walking stick onto the golf course in order to walk from place to place. However, assistance is also required for setting and retrieving golf balls and tees.

Various canes with gripping devices are disclosed in the prior art. Alternatively, various golf ball teeing devices are also known in the prior art.

U.S. Pat. Nos. 3,093,402 and 3,467,116 each disclose a cane with a retrieving device capable of retracting within a hollow cane body. U.S. Pat. Nos. 2,346,038, 4,299,246, and 5,392,800 provide a single pivotable arm disposed on the side of the cane body. U.S. Pat. No. 5,433,234 discloses a cane having a gripping device comprising two arms mounted on the side of the cane body. Similarly, U.S. Pat. No. 4,827,956 shows a motorized gripping means. These devices are ill-suited for setting and retrieving golf balls and tees. Various manifestations of golf ball and tee setting devices may be found, but the devices have inherent limitations with respect to their ability to set golf balls and tees as well as to serve as a cane or walking aid. U.S. Pat. Nos. 2,609,198 and 5,310,177 show asymmetric golf ball and tee setting devices which must be swung away from the set ball and tee in a given rotational arc. U.S. Pat. Nos. 3,904,200, 4,526,369, 4,589,661 and 5,205,598 provide asymmetric devices having a single spring loaded arm which swings away from the set ball and tee in a given direction. Golf ball and tee handling devices having dual arms can also be found. See U.S. Pat. Nos. 2,834,629; 2,943,856; 4,013,295; 4,616,826; 4,714,250; 4,819,938; and 4,949,961. These devices do not provide a desirable support for walking.

The above devices have inherent limitations when used for setting golf balls and tees, retrieving golf balls and tees, and assisting the user in walking. Among these limitations are delicate members which are non-weight bearing and cumbersome spring mechanisms.

Therefore, it is a principal object of this invention to provide a cane device for golf ball and tee setting and retrieving. It is also an object of this invention to provide a cane device which also grasps, retrieves, carries and sets various objects. It is another object of the present invention to provide such a device that transmits and applies a substantially centrally aligned axial force to set a golf ball and tee. It is a further object of this device to provide a retrieving means for objects other than golf balls and tees. It is yet another object of the invention to provide a golf ball and tee setting device which is capable of supporting the body weight of an individual. It is a still further object of the invention to provide a device which is easy to use. It is yet another object to provide a retrieving and setting device which is symmetric about a central longitudinal axis passing through a shaft.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a cane device for manipulating objects such as a golf ball and a tee as well as other objects, the tee having a head portion and a shank portion, and for assisting in supporting the weight of a user against a ground surface. The device comprises: a weight-bearing shaft, having a proximal end and a distal end; a handle disposed at the proximal end of the shaft; a gripping means disposed at the distal end of the shaft for retrieving, grasping, and setting the objects, the gripping means being capable of supporting the weight of the user; an actuation means for activating and deactivating the gripping means, disposed between the handle and the gripping means.

In a further embodiment, the gripping means further comprises a pair of opposing jaw members, each jaw member having a proximal end, disposed at the distal end of the shaft, and a distal end outwardly extending from the shaft, wherein the opposing jaw members are capable of contacting the ground surface and supporting the weight of the user. The pair of opposing jaw means is capable of moving together in a fully closed position and moving apart to a fully open position.

The gripping means preferably further comprises a support frame member adapted to hingedly support the proximal ends of the pair of opposing jaw members, and to support the golf ball, the support frame member being attached to the distal end of the shaft.

Each of the pair of opposing jaw members further preferably comprise a ball support portion disposed between the proximal and distal ends of the jaw member, and a tee support portion disposed at the distal end of the jaw member.

The support frame member further preferably comprises a shaft attachment portion adapted to receive the distal end of the shaft and a ball cupping portion disposed opposite the shaft attachment portion and adapted to receive and support the golf ball.

The cane device may also further include an anti-skid member disposed at the distal end of each of the opposing jaw members for supporting the weight of the user and for reducing skidding between the cane device and the ground surface.

In a preferred embodiment, the weight-bearing shaft is hollow, and the actuation means further comprises an actuation trigger disposed at the proximal end of the shaft, and an actuation connection means connecting the actuation trigger to the pair of opposing jaw members, wherein the actuation connection means is disposed substantially within the hollow shaft. The actuation means may further include a locking mechanism for selectively locking the pair of opposing jaw members in a fully closed position, a fully open position, or a position therebetween.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
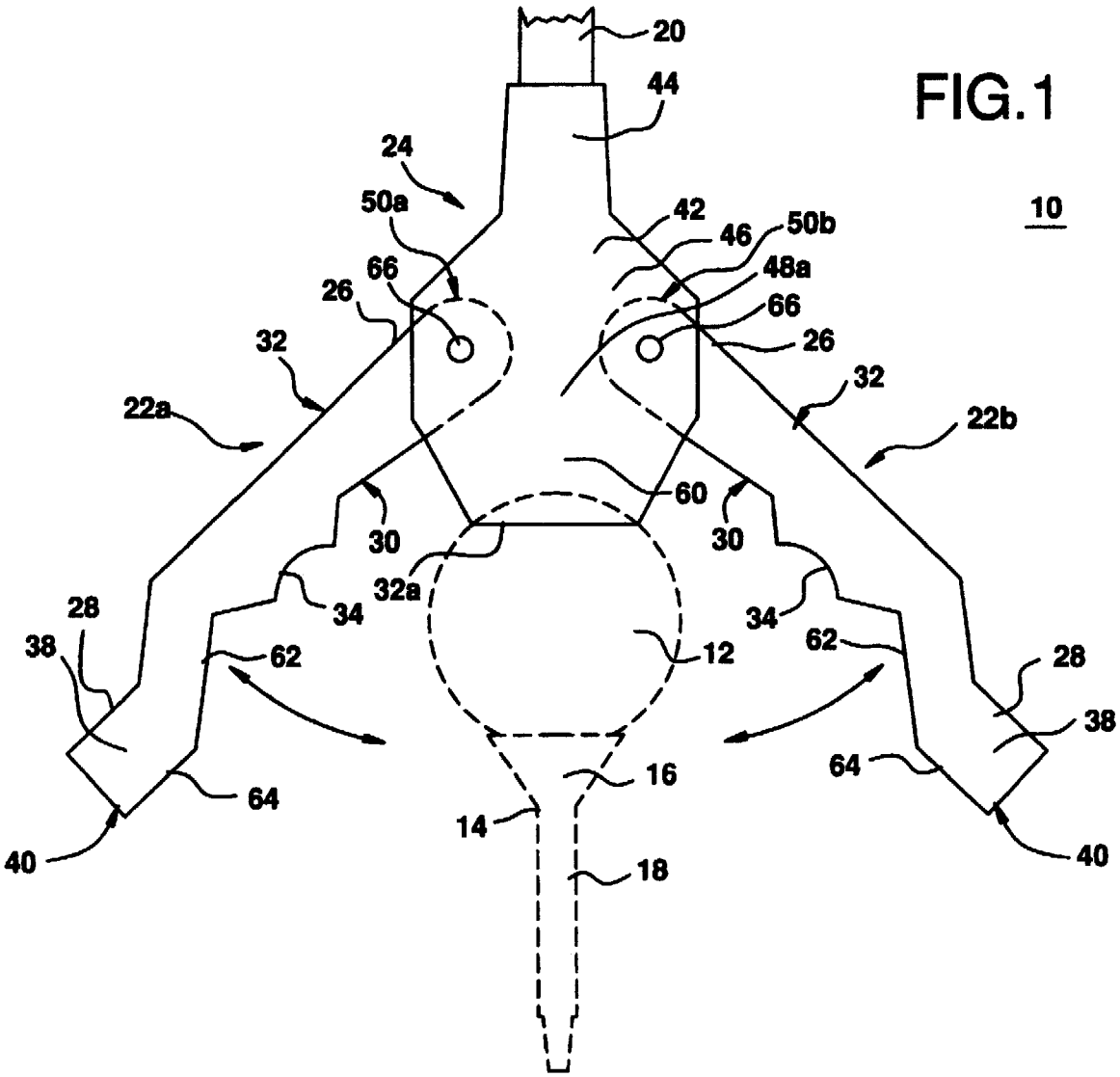
FIG. 1 is a front elevational view of the lower end of a preferred embodiment of the present invention shown in the fully open position after setting a golf ball and tee.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

In a preferred embodiment, the present invention relates to a cane device 10 for retrieving, grasping, setting and generally manipulating a variety of objects. Two of these objects are of particular interest: a golf ball 12 and a tee 14. The tee 14 typically has a head portion 16 and a shank portion 18. The cane device 10 is also primarily intended to support the weight of a user against a ground surface, and therefore functions as a walking aid device. The construction of the cane device 10 provides for various weight bearing portions or members while also performing a grasping function as further illustrated below in a preferred embodiment.

As seen in FIGS. 1 through 7 generally, the device 10 preferably includes a weight-bearing shaft 20 having a proximal end and a distal end, a handle 21, a gripping means or first and second opposing jaw means (22*a*, 22*b*), and a support frame means or support frame member 24. The shaft 20, opposing jaw members 22, and support frame member 24 have the capability of supporting the weight of a user, and the weight-bearing portions preferably may be constructed primarily from a rigid material such as: wood; rigid plastic; composite materials such as graphite; metal or metal alloys such as steel, aluminum, or brass; or some combination thereof. It should be understood that the combined axial length of the shaft 20, opposing jaw means 22, and support frame means 24 should be sufficiently long as to be capable of supporting a standing person. The device 10 may thus be constructed having dimensions to appropriately function as a cane device for users of a particular height range, e.g. a device 10 having a short overall length for users who are relatively short. The overall axial length of the device 10 is preferably determined primarily by the length of the shaft 20. The device 10 may also be constructed to adjustably vary in length to accommodate users of various heights.

Each jaw means or jaw member (22*a*, *b*) has a proximal end 26 disposed at the distal end of the shaft 20, a distal end 28 outwardly extending from the shaft, an inner surface 30, an outer surface 32, a ball support portion 34 which preferably has a concave surface and which is disposed on the inner surface 30 and below the proximal end 26, a tee support portion 36 disposed on the inner surface 30 and near the distal end 28, and an anti-skid member or a weight support portion 38 disposed at the distal end 28 of the jaw means (22*a*, *b*), having a bottom surface 41) for contacting the ground surface. The anti-skid member 38 can support the weight of the user and reduces skidding between the cane device 10 and the ground surface. A cross-sectional view of the concave ball support portion 34 can be seen in FIG. 6. It should be noted that the opposing jaw members (22*a*, *b*) are constructed to be able to directly contact the ground surface and support the weight of the user.

Figures 3, 4, 5, 6, 7:
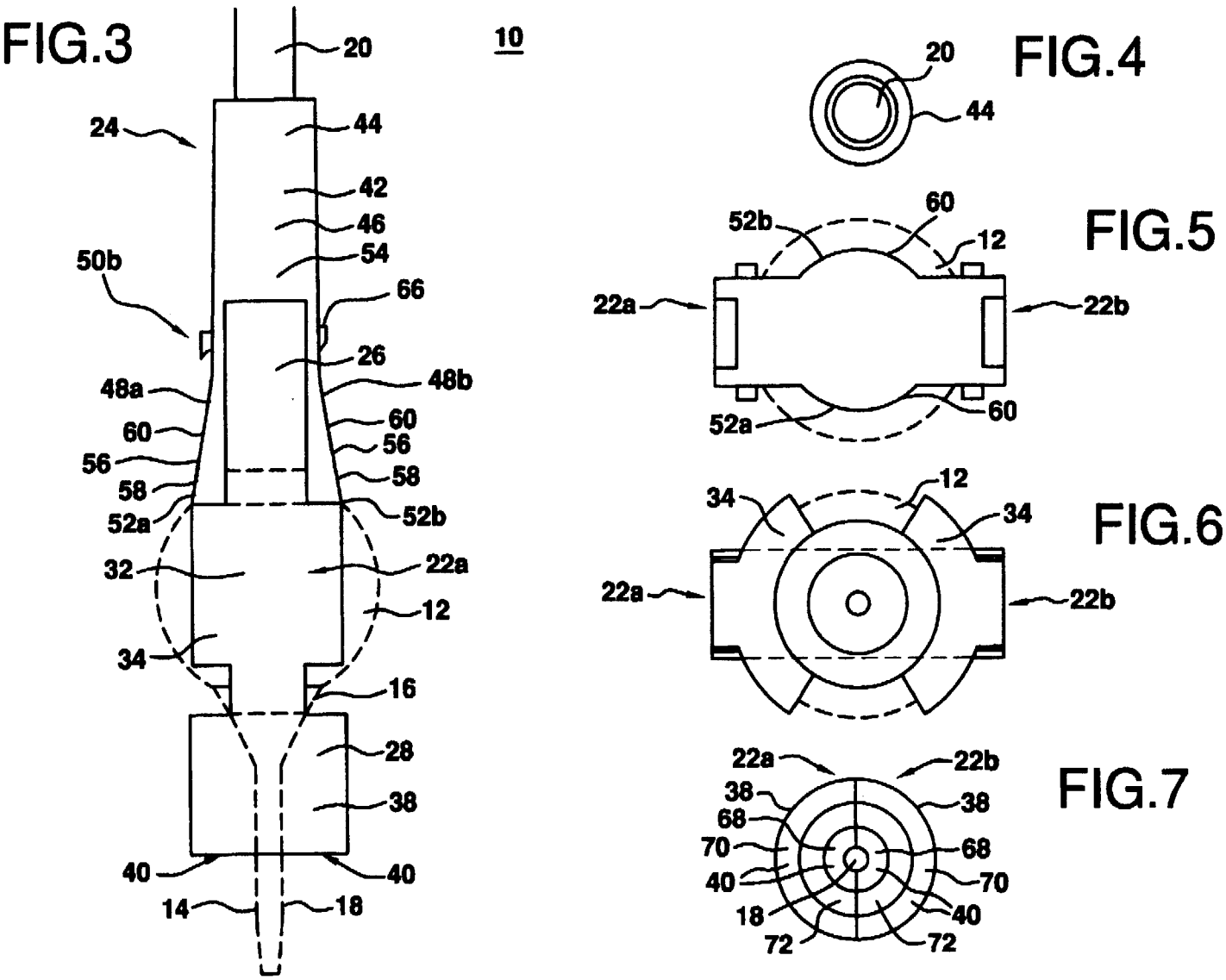
FIG. 3 is a side elevational view of the lower end of a preferred embodiment of the present invention shown in the fully closed position while grasping a golf ball and tee.
FIG. 4 is the cross-sectional view A—A of FIG. 2.
FIG. 5 is the cross-sectional view B—B of FIG. 2.
FIG. 6 is the cross-sectional view C—C of FIG. 2.
FIG. 7 is the cross-sectional view D—D of FIG. 2.
Figure 8:
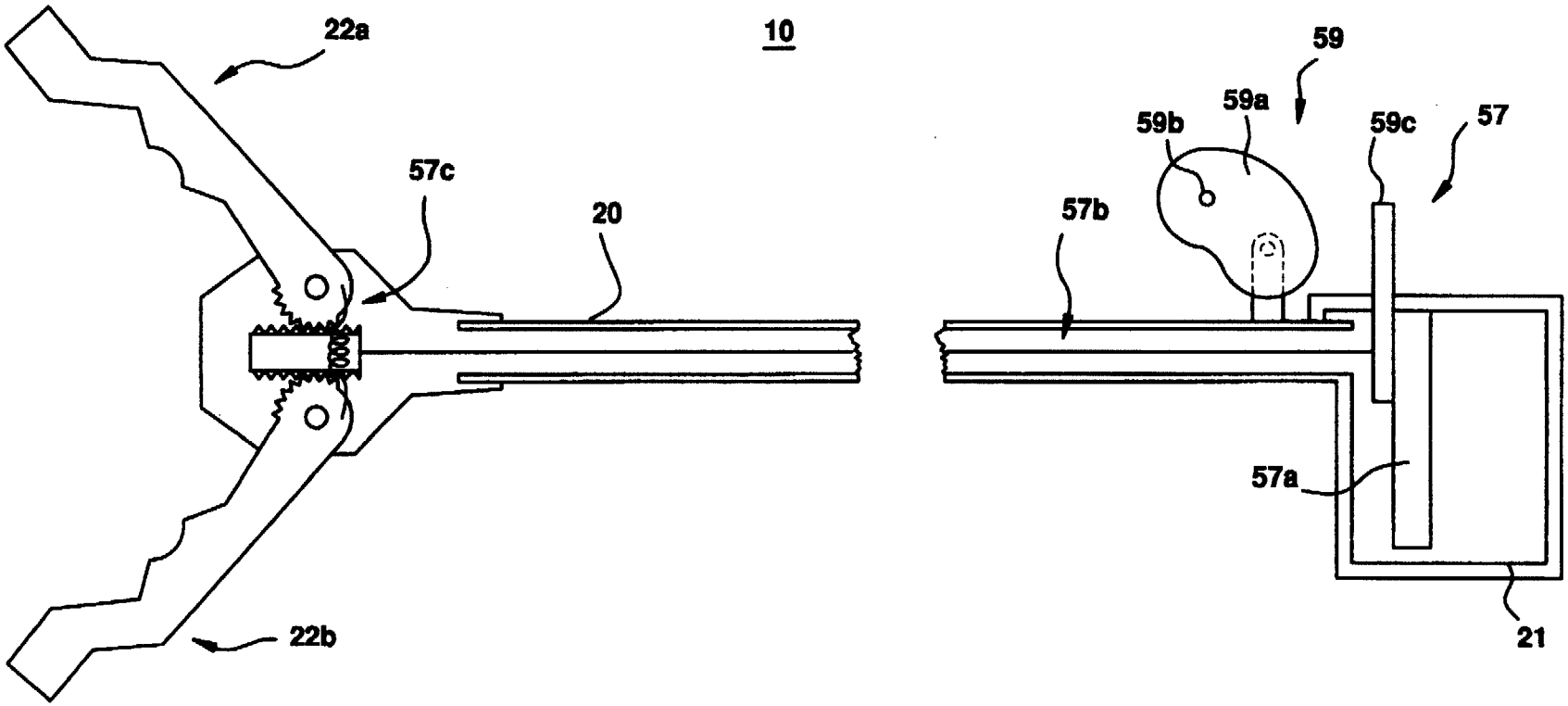
FIG. 8 is a front elevational cutaway view of a preferred embodiment of the present invention in a fully open position.
Figure 9:
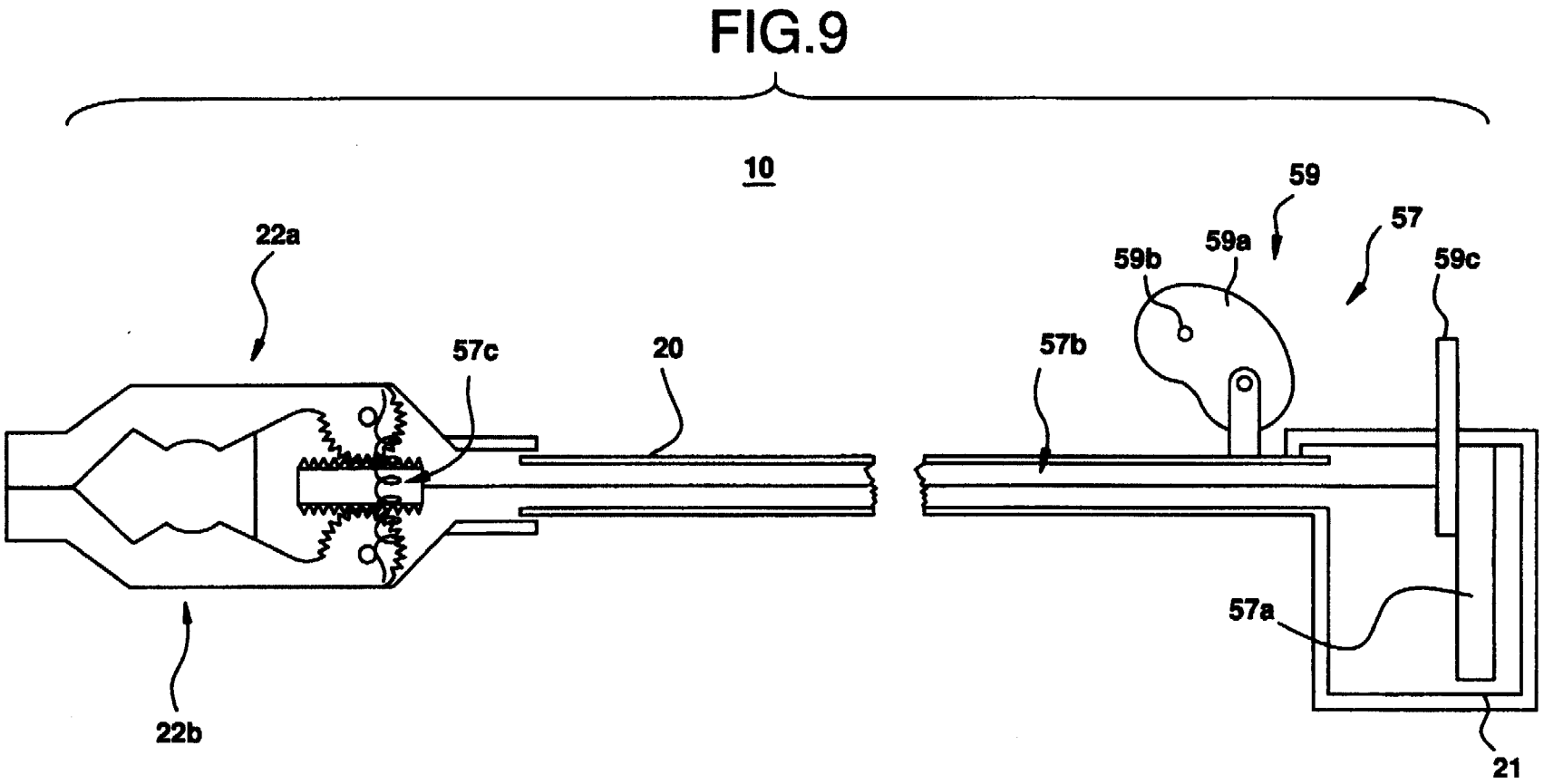
FIG. 9 is a front elevational cutaway view of a preferred embodiment of the present invention in a fully closed position.
Figure 10:
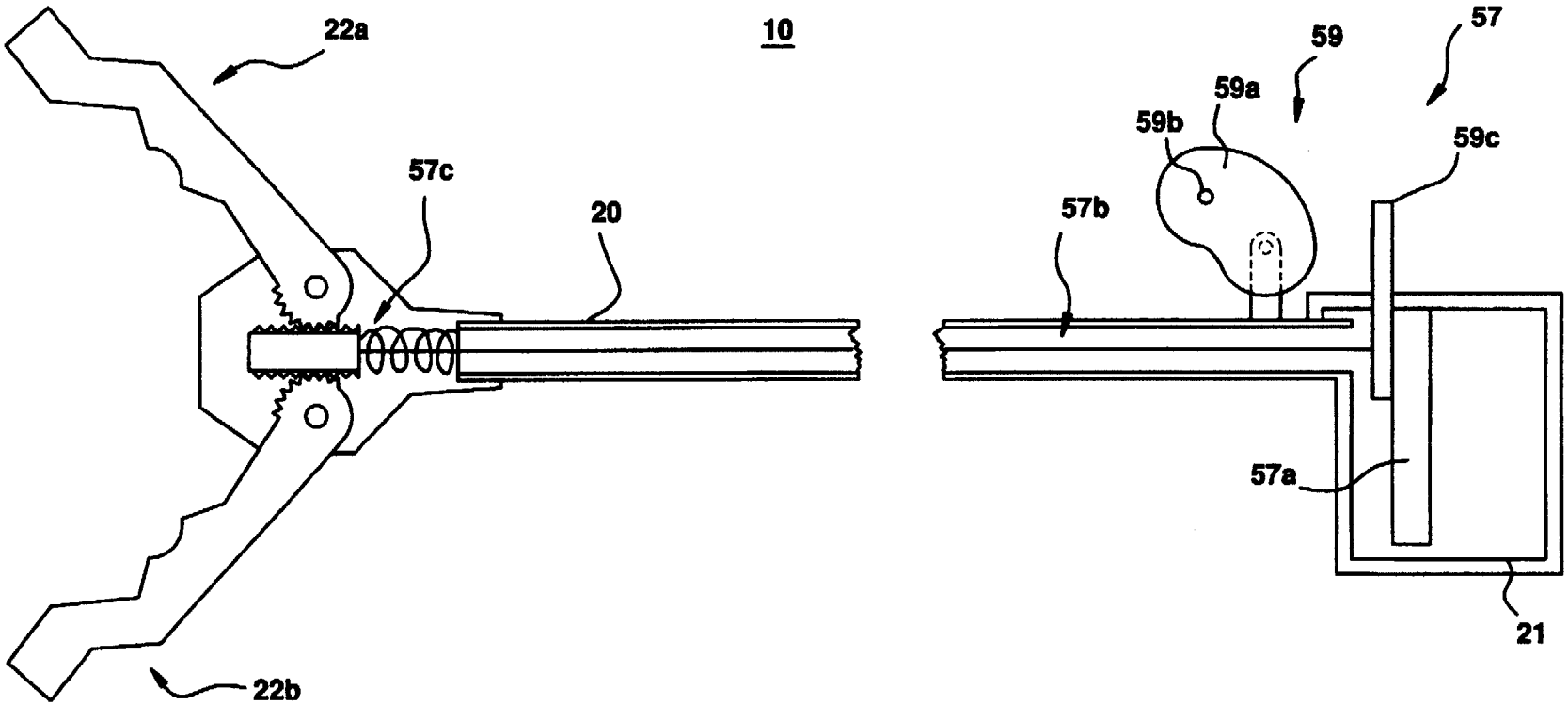
FIG. 10 is a front elevational cutaway view of another embodiment of the present invention in a fully open position.
Figure 11:
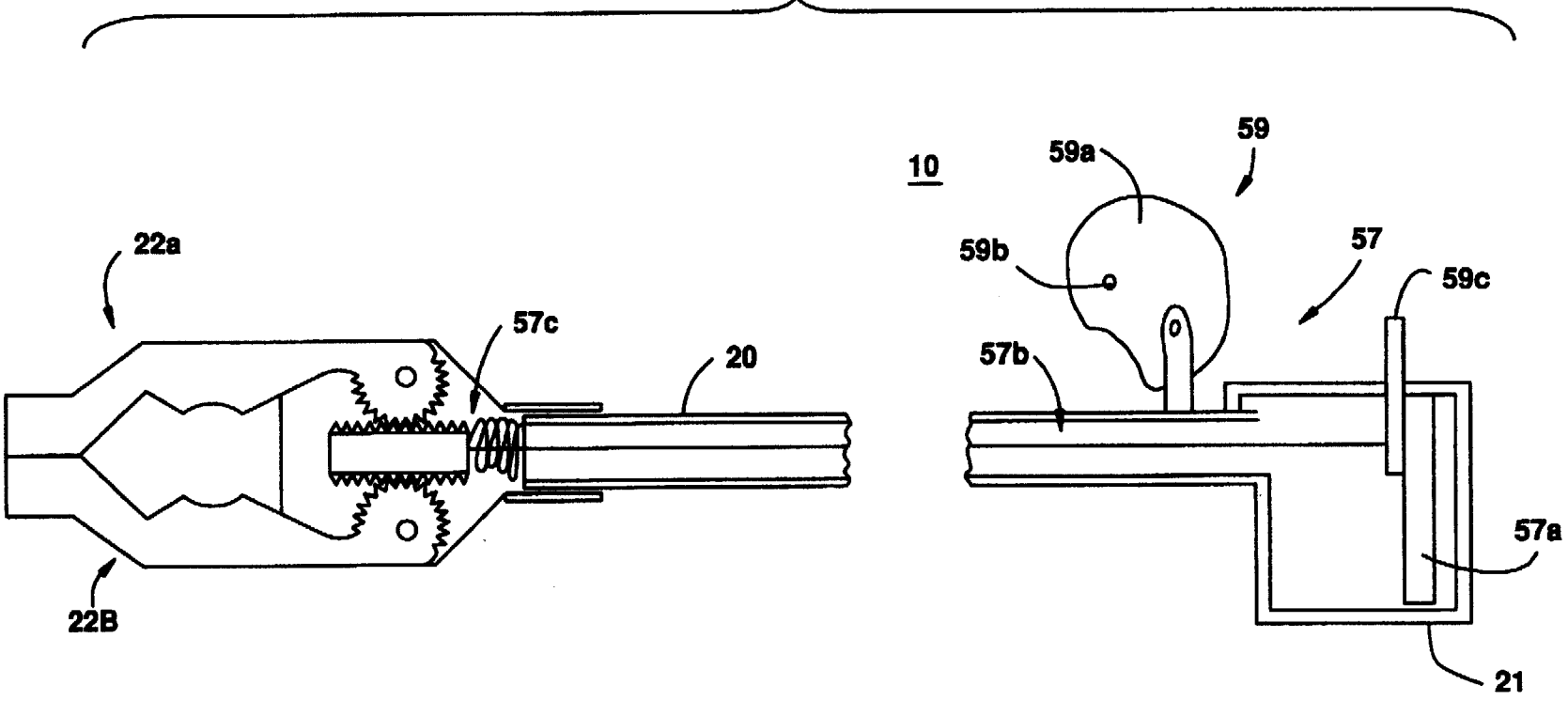
FIG. 11 is a front elevational cutaway view of another embodiment of the present invention in a fully closed position.

The support frame member 24 preferably includes a U-shaped mounting bracket 42 which has a top neck portion 44, a middle portion 46, first and second opposed mounting arms 48*a*, 48*b*, first and second hinge support means 50*a*, 50*b*, and first and second downwardly facing bottom cupping means 52*a*, 52*b*. The top neck portion 44 connects to the shaft 20. A cross-sectional view of the top neck portion 44 is shown in FIG. 4. The middle portion 46 is integrally connected with, and disposed below, the top neck portion 44. The middle portion 46 has a distal end 54 disposed opposite the top neck portion 44. The first and second mounting opposed arms 48*a*, 48*b* downwardly extend from the middle portion 46. Each of the mounting arms 48*a*, 48*b* has a substantially flat inner surface 56 and an outer surface 58. The mounting arms 48*a*, 48*b* are spaced apart, as shown in the figure, such that the substantially flat inner surfaces 56 face each other, and the first and second opposing jaw means 22*a*, 22*b* are disposed between these inner surfaces. The first and second hinge support means 50*a*, 50*b* provide a hinged connection to the proximal end 26 of the first and second jaw means 22*a*, 22*b*, respectively. The first and second downwardly facing bottom cupping means 52*a*, 52*b* provide support for the golf ball 12. The cupping means 52*a*, 52*b* is disposed at the distal end of the first and second mounting arms 48*a*, 48*b*, respectively.

Figure 2:
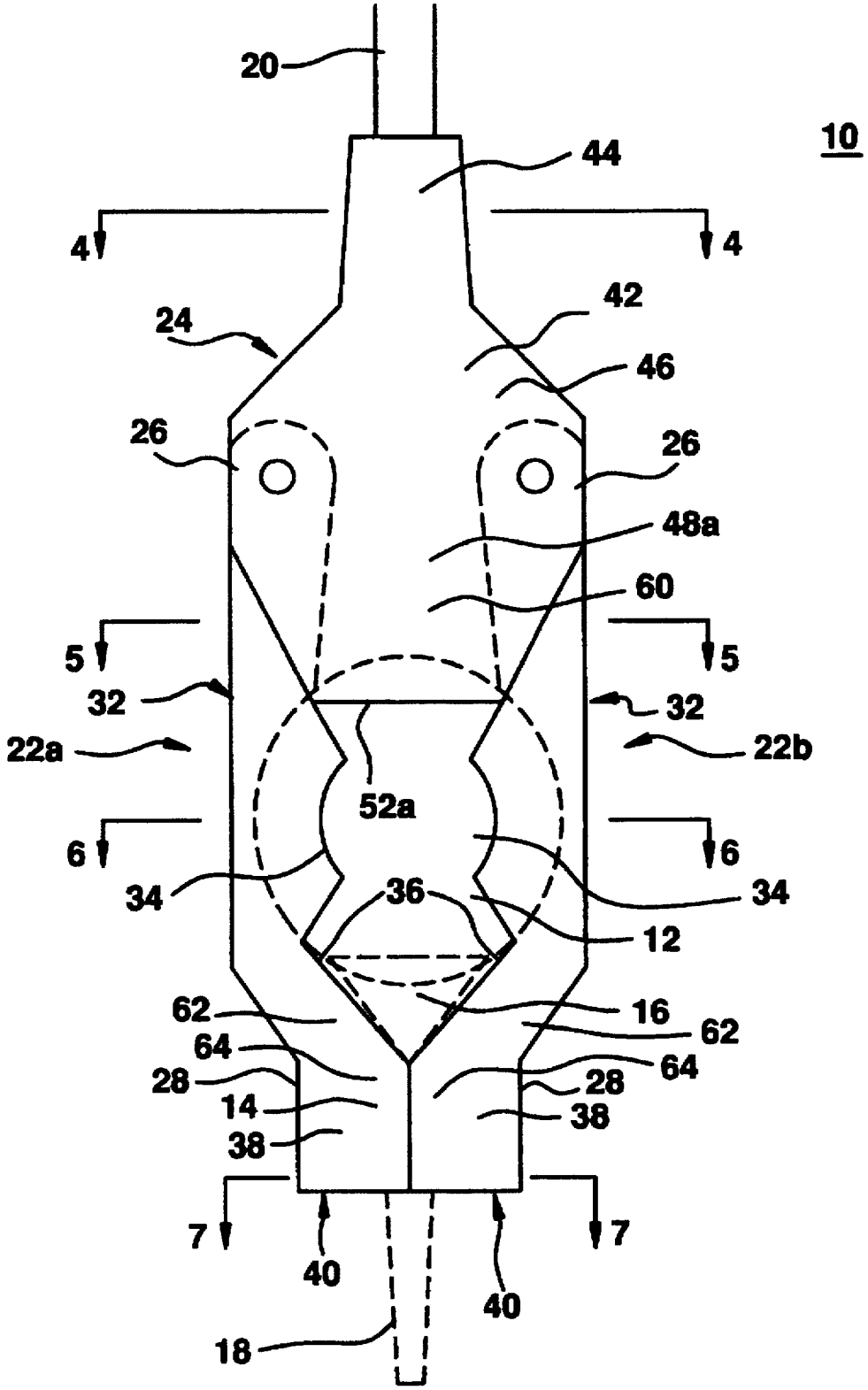
FIG. 2 is a front elevational view of the lower end of a preferred embodiment of the present invention shown in the fully closed position while setting a golf ball and tee.

The first and second opposed jaw means 22*a*, 22*b* are thus able to move together to a fully closed position as illustrated in FIG. 2 and are capable of moving apart to a fully open position as shown in FIG. 1.

The present invention also comprises an actuation means 57 for activating and deactivating the gripping means (22*a*, *b*), i.e., moves the first and second opposing jaw members 22*a*, 22*b* at the instance of the user. The actuation means 57 is preferably disposed between the handle 21 and the gripping means (22*a*, *b*). The device is preferably in the fully open position in its resting state. As seen in the embodiments in FIGS. 8–11, the actuation means 57 preferably comprises the following: a trigger means or an actuation trigger 57*a* disposed at the proximal end of the shaft 20, the actuation trigger capable of being pulled by the user when the user desires to grasp an object; and an actuation connection means 57b connecting the actuation trigger 57a to the pair of opposing jaw members (22a, b). The actuation connection means 57b may comprise: a cable means connecting the actuation trigger 57a to the proximal end 26 of each of the jaw members 22a, 22b such that translation of the cable means rotates the jaw members 22a, 22b about the first and second hinge support means 50a, 50b, enabling the jaw means 22a, 22b to be extended into a closed or partially closed position when the cable means is moved toward the proximal end of the shaft by the trigger means 57a; and a biasing spring means 57c for biasing the device in the fully open position in its resting state, the biasing spring means connecting the proximal ends of the two jaw means 22a, 22b. Preferably the shaft 20 and support frame member 24 are hollow such that the cable means and spring biasing means are disposed within the shaft and support frame member. Alternatively, the cable means and/or the spring biasing means may be externally mounted along the outside surface of the shaft 20 and/or support frame member 24. The proximal end 26 of each jaw member (22a, b) may be provided with inwardly facing arcuate gear teeth, and the distal end of the cable means may include a spline means having two opposed faces upon which are disposed mating planar gear teeth corresponding to the arcuate gear teeth, whereby the spline means is translated toward the proximal end of the shaft when the user squeezes the trigger means while the planar gear teeth mesh with the arcuate gear teeth, resulting in the rotation of the jaw means 22a, 22b about the first and second hinge support means 50a, 50b.

Figure 12:
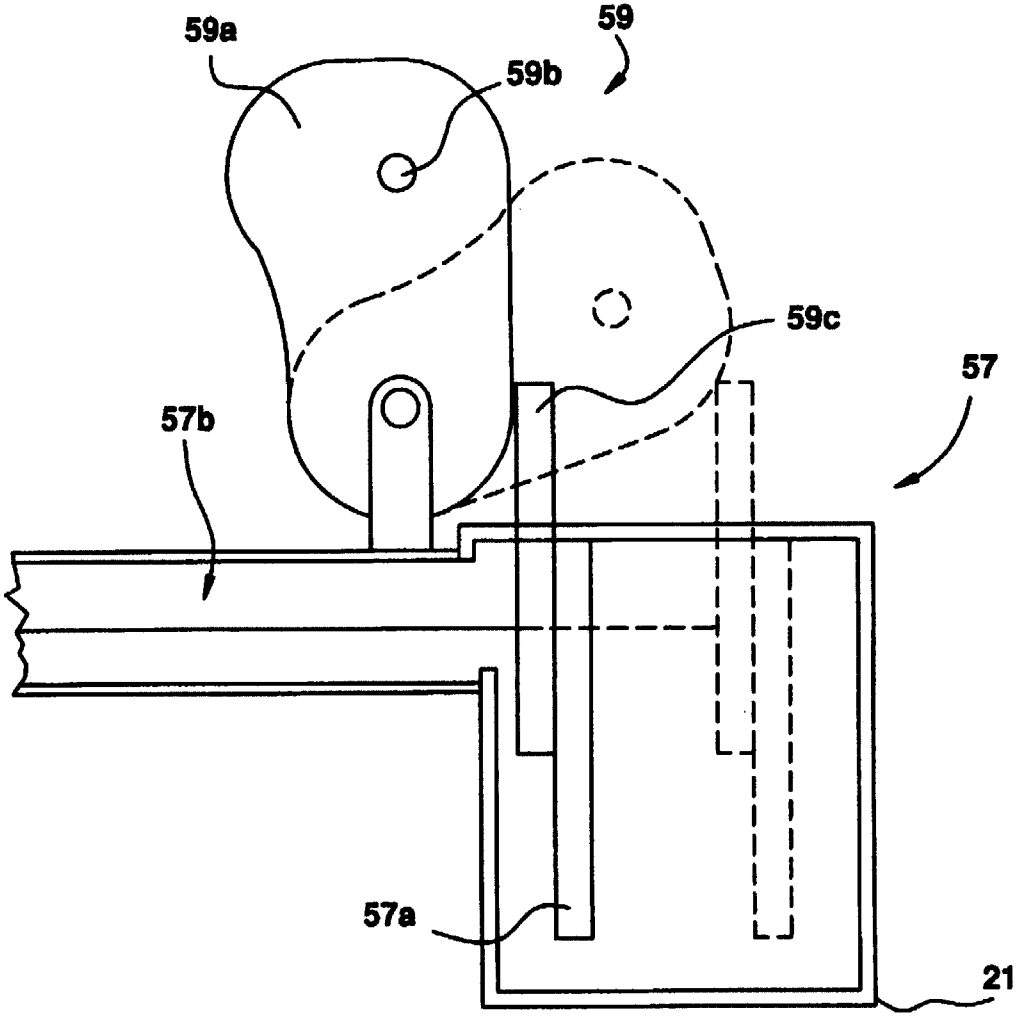
FIG. 12 is a partial front elevational cutaway view of the upper end of a preferred embodiment of the present invention showing a first locked position as well as a second locked position in dashed lines.

Moreover, the device 10 is preferably used in conjunction with a locking means or locking mechanism 59 in addition to the actuation means. The locking means 59 enables the first and second opposing jaw members 22a, 22b to lock in a selected position which may be fully closed, fully open, or a position somewhere therebetween. Preferably, as seen in FIG. 12, the locking mechanism comprises the following: a cam 59a rotatably disposed proximate the handle; a lever 59b extending from the axis of the cam; and a follower 59c disposed at the proximal end of the cable means; wherein the cam is disposed between the follower and the distal end of the shaft, and wherein the cable means is prevented from translating toward the distal end of the shaft 20 as the movement of the follower toward the distal end of the shaft 20 is arrested by the cam. Thus, the user may lock the jaw members (22a, b) at a selected position by rotating the lever 59b until the larger radii of the cam 59a engage the follower 59c. To release the locking mechanism, the user may rotate the lever 59b in the opposite direction such that smaller radii of the cam 59a engage the follower 59c.

In order to use the device 10 as an aid in walking, the user would preferably activate the actuation means 57 such that the jaw means 22a, 22b are in a fully closed position as seen in FIG. 2, then activate the locking means 59 to maintain the jaw means 22a, 22b in the closed position. Thus, the device 10 would preferably remain in the closed position so as to serve as a walking aid, although the device 10 serves as walking device while the jaw members (22a, b) are in any position. The device 10 may then be unlocked whenever the user desires to grasp an object. The biasing spring means 57c preferably urges the jaw means 22a, 22b in the open position to grasp articles.

A compatible actuation means 57 and locking mechanism 59 may be of the type found on the Winchester™ Reacher of North Coast Medical, Inc. in San Jose, Calif.

As best seen in FIGS. 3 and 5, the first and second opposed mounting arms 48a, 48b further include an outwardly and downwardly extending concave middle portion 60. The tee support portion 36 further includes a tapered tee head support portion 62, and a cylindrical tee body support portion 64. The tee body support portion 64 has an inner diameter which is substantially equal to the shank portion 18 of the tee 14. The inner diameter of the tee body support portion 64 may be slightly greater than or slightly lesser than the diameter of the shank portion 18 of the tee 14 without departing from one of its functions, namely the support of the tee 14. The tee body support portion 64 is disposed below the tapered tee head support portion 62.

The first and second hinge support means 50a, 50b includes a hinge pin 66 perpendicularly disposed through the first and second mounting arms 48a, 48b and through the first and second jaw means 22a, 22b, respectively, for pivotally mounting the jaw means.

As best seen in FIG. 7, the weight support portion or anti-skid member 38 preferably has a first semi-cylindrical bottom flange 68 disposed on the bottom surface 40. The bottom flange 68 has an inner perimeter and an outer perimeter. The inner perimeter has a radius substantially equal to but larger than the radius of the shank portion 18 of the tee 14, so that the flange 68 can securely but releasingly engage the tee 14. The anti-skid member 38 further includes at least one semi-cylindrical concentric bottom flange 70 disposed on the bottom surface 40 surrounding the first flange 68. The concentric bottom flange 70 is concentric with the first semi-cylindrical bottom flange 68, and has an inner perimeter with a radius larger than the radius of the outer perimeter of the first semi-cylindrical bottom flange 68. When the device is in the fully closed position, first semi-cylindrical bottom flanges 68 and the semi-cylindrical concentric bottom flanges 70 form concentric rings on the bottom of the weight support portion 38 interspaced by cylindrical recesses 72. This configuration helps to prevent slippage of the device 10 when used as a walking aid.

The shaft 20 may preferably include an attachment means for attaching the device 10 to a belt, a belt buckle, an article of clothing, a golf bag, a golf cart, or some other object which is convenient for the user to temporarily place the device 10 in a storage position.

In order to use the device 10 in a preferred manner, the user would preferably activate the actuation means 57 such that the first and second opposing jaw means 22a, 22b are in a fully closed position, as illustrated in FIG. 2. The user would then walk while being assisted by the device 10 by engaging the bottom 40 of the anti-skid member or weight support portion 38 with the ground. Preferably the user has also activated a locking means 59 for maintaining the jaw members 22a, 22b in that fully closed position. If the user is golfing and is about to tee off, the user would grab a golf ball 12 and tee 14 from a golf bag in one hand while holding the device 10 in the other hand. After opening the jaw members 22a, 22b to a fully open position, the user would place the golf ball 12 against the first and second downwardly facing bottom cupping means 52a, 52b on the U-shaped mounting bracket 42. The jaw means 22a, 22b can then be closed to envelope the golf ball 12 with the concave ball support portions 34 of the first and second jaw members 22a, 22b, until the jaw means are nearly closed. The tee 14 may then be inserted beneath the ball 12 so as to engage the tee 14 with the tee support portion 36. The jaw means 22a, 22b are then closed to a fully closed position with the golf ball 12 and tee 14 securely embraced by the device 10. The user may then optionally lock the jaw means 22a, 22b in that position. The user would then insert the tee 14 into the ground at a desired tee height, by applying a downward axial force through the shaft 20, the U-shaped mounting bracket 42, the ball 12 and the tee 14. The user may push the device 10 and insert the tee into the ground until the bottom surface 40 of the jaw means (22*a, b*) abuts the ground, thus enabling the user to insert the tee to a uniform depth each time. The jaw members 22*a*, 22*b* are then released from their grip on the ball 12 and tee 14, whereby both jaw means 22*a*, 22*b* swing away from the ball and tee in unison. The device 10 is then moved away from the set ball 12 and tee 14 and can immediately be used as a cane or walking aid. Alternately, instead of moving the device 10 away from the set ball 12 and tee 14, the user may choose to further insert the ball 12 and tee 14 into the ground by maintaining the jaw members 22*a*, 22*b* in a partially open or fully open position while exerting a downward axial force through the shaft 20 and the U-shaped mounting bracket 42 without the additional support of the jaw means 22*a*, 22*b*, thereby causing the tee 14 to be driven further into the ground.

The anti-skid member or weight support portion 38 may be constructed of rubber, plastic, or other material which has a relatively high coefficient of friction that would retard slippage between the bottom end of the device 10 and the ground, yet which is durable enough to support the weight of the user. Additionally, the antiskid member 38 may comprise a removable cane-tip insert which can be, for example, glued or press fit onto the first and second opposing jaw means 22*a*, 22*b* to provide a substantially non-slip bottom surface 40.

It should be understood that the shaft 20, neck portion 14, U-shaped mounting bracket 42, golf ball 12, and tee 14 all share a common longitudinal axis during insertion; whereby the user need not apply eccentric loads, nor does the user experience off-center targeting difficulties, when inserting the tee into the desired position in the ground.

It should be further understood that the device 10 can easily retrieve, transport, and set various objects other than golf balls and tees even though the device is preferably configured to accommodate golf balls and tees. By way of example, the user could utilize the device to pick up a golf club, a hat, a towel, or a scorecard. The device can additionally be used around the house, the yard, or other indoor or outdoor areas where a person with limited flexibility would walk and perform a retrieving or setting task. By way of further example, the device could successfully be used to pick up papers, cans, bottles or other litter from the ground.

The device 10 may also include one or more downwardly extending stabilizing legs which depend from the support frame member 24 and which are preferably disposed in a vertical plane other than that occupied by the jaw means 22*a*, 22*b*. The legs may also depend from the shaft 20. The legs may also be substantially disposed within the vertical plane of the jaw means 22*a*, 22*b* provided the legs do not interfere with the movement of the jaw means 22*a*, 22*b*, for example if the legs extend outwardly and downwardly far enough away from the jaw members (22*a, b*) that the jaw members may freely open and close without interference with the legs. If two stabilizing legs are provided, the legs are preferably disposed in a vertical plane substantially perpendicularly to the vertical plane of the jaw members 22*a*, 22*b*. Each stabilizing leg is weight-bearing and preferably includes a non-slip bottom surface and/or an anti-skid member.

The above examples are provided to illustrate some of the capabilities of the device 10, and are not intended to limit its scope.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A cane device for manipulating objects, the objects including a golf ball and a tee, the tee having a head portion and a shank portion, and for assisting in supporting the weight of a user against a ground surface, said cane device comprising:

a weight-bearing shaft having a proximal end and a distal end;

a handle disposed at the proximal end of said shaft;

a gripping means disposed at the distal end of said shaft for retrieving, grasping, and setting the objects, said gripping means being capable of supporting the weight of the user;

an actuation means for activating and deactivating said gripping means, disposed between said handle and said gripping means; and anti-skid means disposed on said gripping means for preventing said cane device from slipping with respect to the ground surface and for supporting the weight of the user;

wherein said gripping means further comprises a pair of opposing jaw members, each jaw member having a proximal end, disposed at the distal end of the shaft, and a distal end outwardly extending from said shaft;

wherein said anti-skid means is disposed at the distal end of each of said jaw member;

wherein said opposing jaw members are capable of contacting the ground surface and supporting the weight of the user;

wherein said pair of opposing jaw means is capable of moving together in a fully closed position and moving apart to a fully open position;

wherein said gripping means further comprises a support frame member adapted to hingedly support the proximal ends of said pair of opposing jaw members, and to support the golf ball, said support frame member being fixedly attached to the distal end of said shaft; and wherein said support frame member further comprises a shaft attachment portion, adapted to receive the distal end of said shaft, and a pair of spaced apart downwardly extending mounting arms, wherein each of said opposing jaw means are hingedly attached between said mounting arms, wherein said opposing jaw means are movably disposed between said mounting arms, and wherein each of said mounting arms has a ball cupping portion disposed at the distal edge for providing support for the golf ball.

2. The cane device according to claim 1 wherein said ball cupping portions of said mounting arms generally extend transversely outside the plane of the opposing jaw members.

* * * * *